United States Patent [19]

Sumerau

[11] Patent Number: 4,763,382

[45] Date of Patent: Aug. 16, 1988

[54] VACUUM CLEANER HANGING ARRANGEMENT

[75] Inventor: William R. Sumerau, Easley, S.C.

[73] Assignee: The Singer Company, Stamford, Conn.

[21] Appl. No.: 148,522

[22] Filed: Jan. 26, 1988

[51] Int. Cl.[4] ..... A47L 9/00

[52] U.S. Cl. ..... 15/323; 15/327 C; 15/336

[58] Field of Search ..... 15/323, 327 C, 336

[56] References Cited

U.S. PATENT DOCUMENTS

| | | | |
|---|---|---|---|
| 2,210,952 | 8/1940 | Replogle | 15/336 |
| 2,595,752 | 5/1952 | Batts | 15/327 C X |
| 2,639,456 | 5/1953 | Smith | 15/323 X |
| 3,273,194 | 9/1966 | Jepson et al. | 15/323 |
| 3,286,446 | 11/1966 | Happe et al. | 15/327 C X |
| 4,586,214 | 5/1986 | Berfield | 15/327 C |
| 4,660,246 | 4/1987 | Duncan et al. | 15/329 |
| 4,662,026 | 5/1987 | Sumerau et al. | 5/329 |
| 4,670,937 | 6/1987 | Sumerau et al. | 15/329 |

FOREIGN PATENT DOCUMENTS

| | | | |
|---|---|---|---|
| 122421 | 8/1948 | Sweden | 15/327 C |

*Primary Examiner*—Chris K. Moore

*Attorney, Agent, or Firm*—David L. Davis

[57] ABSTRACT

A vacuum cleaner of relatively compact and lightweight construction provides a generally planar lower surface having a reinforced keyhole integrally associated therewith for hanging the vacuum cleaner preferably on a planar support surface, such as a wall, during periods of non-use of the vacuum cleaner.

10 Claims, 2 Drawing Sheets

VACUUM CLEANER HANGING ARRANGEMENT

BACKGROUND OF THE INVENTION

In general, this invention concerns a vacuum cleaner having a hanging feature, and in particular concerns a vacuum cleaner combining a relatively compact, lightweight construction together with a keyhole feature for hanging storage of the vacuum cleaner during periods of non-use.

Heretofore, larger scale vacuum cleaners have typically been constructed in either permanent upright or canister-type embodiments. In general, such vacuum cleaners can be characterized as relatively bulky and/or of relatively greater weight. Due to their weight and size, it is generally not practical for such upright and canister-style cleaners to be supported off the floor in a hanging position during periods of non-use thereof.

In relatively recent times, with the introduction of improved materials and motors, the size and weight of vacuum cleaners have been reduced while effectively maintaining adequate levels of vacuum power. However, generally no provisions have been made for such new generation of vacuum cleaners in an upright or convertible upright construction to be particularly adapted for hanging support thereof.

More recently, a vacuum cleaner has become known which is convertible between upright and hand-held configurations, though not particularly adapted for hanging support. See for example U.S. Pat. Nos. 4,660,246 (Duncan et al.); 4,662,026 (Sumerau et al.); and 4,670,937 (Sumerau et al), all of which patents are commonly assigned with the present application. The disclosures of such patents are incorporated herein by reference, particularly with respect to the operational details (e.g. vacuum sources, etc.) and convertible features thereof.

SUMMARY OF THE INVENTION

The present invention recognizes and addresses the general prior lack of hanging features or arrangements for vacuum cleaners, particularly concerning upright or convertible upright styles (i.e., vacuum cleaners other than relatively small scale, battery-operated hard-held units). Accordingly, it is one general object of the present invention to provide an improved vacuum cleaner which is particularly adapted for convenient and relatively compact hanging storage thereof during periods of non-use.

It is a more particular object of the present invention to provide such an improved vacuum cleaner for integral storage in a space-saving configuration of both itself and its associated power cord. It is a still further particular object to provide such a vacuum cleaner which is adapted to hang substantially flush against a planar support surface, such as a wall, preferably from a support member such as a nail or screw mounted on such wall.

It is yet another object of the present invention to provide such an improved vacuum cleaner for hanging storage which is of relatively lightweight construction, while possessing operational and functional features of vacuum cleaners having upright and/or convertible upright-type constructions.

Different features and characteristics of the present invention may be embodied in various combinations for providing a vacuum cleaner constructed in accordance with the present invention. One exemplary such embodiment generally includes a vacuum cleaner having a head portion incorporating a vacuum nozzle; a body portion incorporating a collecting bag, the body portion being operatively and pivotably associated with the head portion, and upon selected pivoting thereof further defining together with the head portion a generally planar lower surface; cord storage means, received on the generally planar lower surface, for storing a coiled power cord for such vacuum cleaner in a storage plane generally parallel to and immediately adjacent to such generally planar lower surface; and vacuum cleaner hanging means, substantially facing such planar lower surface, and adapted for supporting the vacuum cleaner on an external support member mounted on a wall or similar planar support surface; with the vacuum cleaner planar lower surface substantially facing towards such planar support surface, and with the vacuum cleaner power cord stored on the cord storage means so as not to interfere with operation of the hanging means.

Another exemplary embodiment of the present invention concerns a vacuum cleaner adapted for hanging storage thereof during periods of non-use, such vacuum cleaner comprising a main chassis, including a lower side thereof defining a first substantially planar surface, at least one vacuum nozzle directed towards such chassis lower side, at least one exhaust port located generally towards the rear of such chassis, and at least one vacuum channel operatively interconnecting the vacuum nozzle with the exhaust port. The embodiment also includes a body compartment adapted for supporting a dirt collection bag having an input orifice operatively interconnected with the chassis exhaust port, such body compartment having generally opposing ends, one of which is pivotably attached to the chassis rear, and the other of which is generally adjacent the bag input orifice, such body compartment further having a lower side thereof defining a second planar surface, with a trough formed substantially centrally in such body compartment lower side and running longitudinally therealong. Such embodiment further includes flexible tubing means, received substantially within the body compartment lower side trough, for operatively interconnecting the chassis exhaust port with the bag input orifice; suction means for transporting dirt and dust from generally adjacent the vacuum nozzle to the dirt collection bag, via the vacuum channel, the exhaust port, the tubing means, and the bag input orifice; and a power cord for selectively interconnecting the suction means with input power from a source such as a wall socket. Still further included are cord wrapping means, including two respective pairs of elements with each such pair generally associated with respective opposing ends of the bag compartment and relatively adjacent the lower side trough thereof for defining a third substantially planar surface which is parallel to and slightly spaced from the second planar surface, the cord wrapping means being further adapted for coiled receipt of the power cord therearound, generally in a plane within an area defined between such slightly spaced second and third planar surfaces; and tubing cover means, situated across one end of the body compartment lower side trough, for covering the interconnection between the tubing means and the bag input orifice, the cover means further being situated between a pair of the cord wrapping means elements, and defining centrally relative the vacuum cleaner a support opening adapted for receipt of a support member therein; whereby, with the body compartment pivotably situated relative the main chassis such that their respective lower side planar surfaces are substantially in co-planar alignment, the vacuum cleaner may be stored during periods of non-use by hanging the support opening thereof on a support member, with the power cord wrapped about the cord wrapping means so as to generally not disturb the substantially planar nature of the planar surfaces so that the vacuum cleaner may be positioned substantially flush against a surface, such as a wall, from which the support member protrudes.

Various further alternative features, such as particular integral keyhole members, and reinforcement thereof, may be provided in further embodiments in accordance with the present invention. Moreover, those of ordinary skill in the art will recognize various modifications and variations to different features and characteristics of the present invention, all of which are intended to come within the spirit and scope of the present invention by virtue of present reference thereto. Such modifications include, but are not limited to, substitution of various functional equivalents for particular features and characteristics illustrated or discussed, or the reversal of illustrated characteristics.

Additionally, general concepts and principles of the present invention may be applied to particular vacuum cleaner constructions or styles differing from the exemplary construction illustrated in the accompanying drawings. The selection and incorporation of various present features into given alternative constructions is considered to fall within the skill of those of ordinary skill in the art, without further particular discussion or explanation herewith.

BRIEF DESCRIPTION OF THE DRAWINGS

A full and enabling disclosure of the present invention, including the best mode thereof, is set forth more particularly in the remainder of the present specification, which includes reference to the accompanying drawings, in which.

Repeat use of like reference characters throughout the specification and accompanying drawings is intended to represent same or analogous features or elements of the present invention.

DETAILED DESCRIPTION OF THE PREFERRED EMBODIMENT

As indicated above, principles and features of the present invention may be applied to vacuum cleaners of various alternative constructions. However the presently preferred exemplary embodiment of the present invention is illustrated as generally incorporated into a convertible upright/hand-held construction, as disclosed in relative detail in the above-mentioned three United States patents (all of which disclosure is incorporated herewith). Hence, repeat explanation of some details not particularly concerning present features, such as those concerning the vacuum operation or convertibility of such exemplary embodiment, are omitted from this specification.

Figure 1:
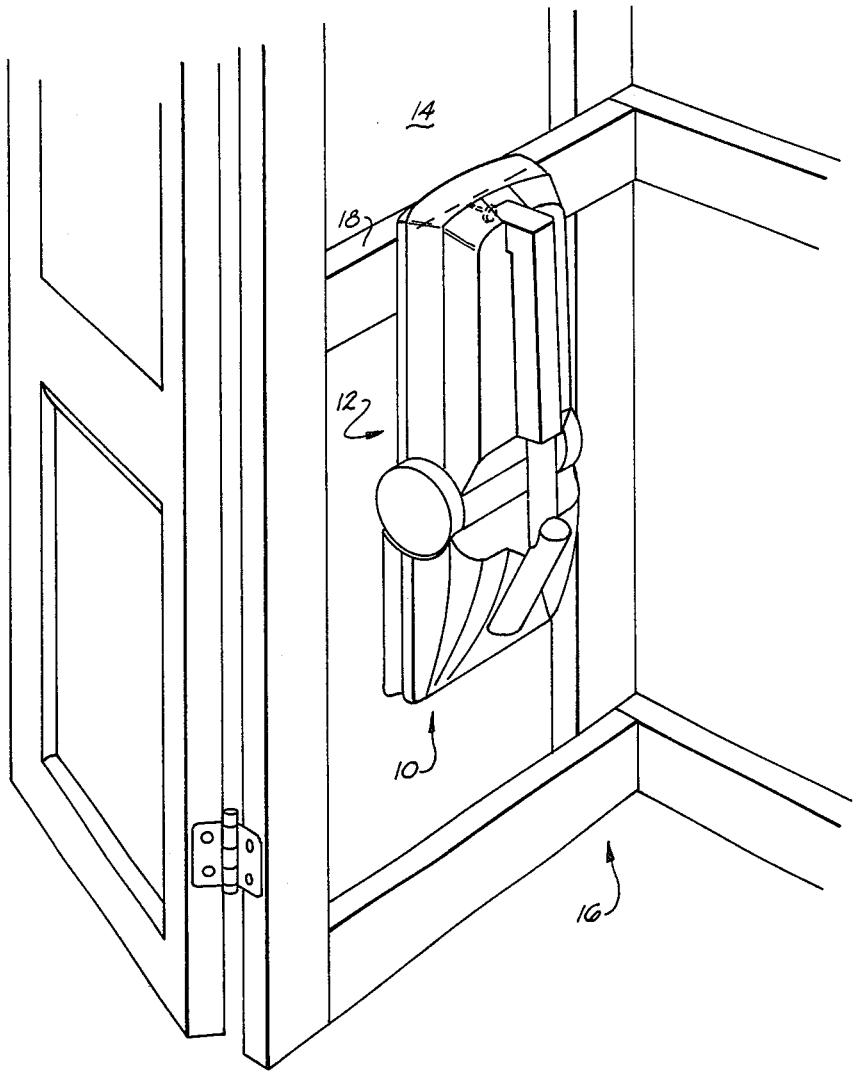
FIG. 1 illustrates a perspective view of an exemplary embodiment in accordance with the present invention, during hanging storage thereof.

FIG. 1 illustrates a vacuum cleaner 10 generally of the convertible type mentioned above, and constructed in accordance with the present invention for hanging storage. The vacuum cleaner is particularly constructed for providing a generally planar lower surface 12, and hanging means associated therewith (not illustrated in FIG. 1). In general vacuum cleaner 10 comprises relatively lightweight materials, preferably so as to have a total weight of no more than about ten pounds (though higher weights could be accommodated if desired in connection with particular alternative constructions). Such lightweight feature contributes to the advantageous hanging feature of vacuum cleaner 10, which is more particularly achieved with the hanging means and overall configuration thereof, including the power cord storage discussed more particularly below with reference to FIGS. 2 and 3.

Though a vacuum cleaner constructed in accordance with the present invention may be stored on various alternative support members virtually without limitation, storage adjacent a generally planar surface such as wall 14 of closet 16 is preferred. A support member such as a nail or screw may be mounted relative wall 14, such as in a beam 18 thereof. Vacuum cleaner 10 may then be hung from such support member so as to lie substantially flush adjacent planar support surface 14, either slightly spaced therefrom (as particularly illustrated in present FIG. 1) or directly flush thereagainst (as may be understood by those of ordinary skill in the art).

Of course, planar support surface 14 need not be strictly vertical, but may instead comprise an angled support wall as sometimes found in upstairs closets over staircases or in other circumstances. In such instance, vacuum cleaner 10 could be supported on the angled support wall, substantially at the angle thereof, with the hanging feature discussed below securing the vacuum cleaner to such wall.

Figure 2:
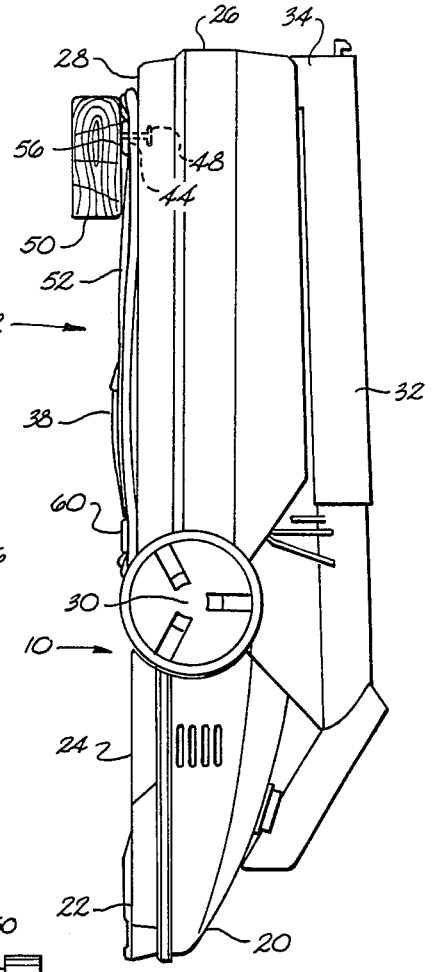
FIGS. 2 and 3 illustrate side and rear elevational views, respectively, of the exemplary embodiment of present FIG. 1.
Figure 3:
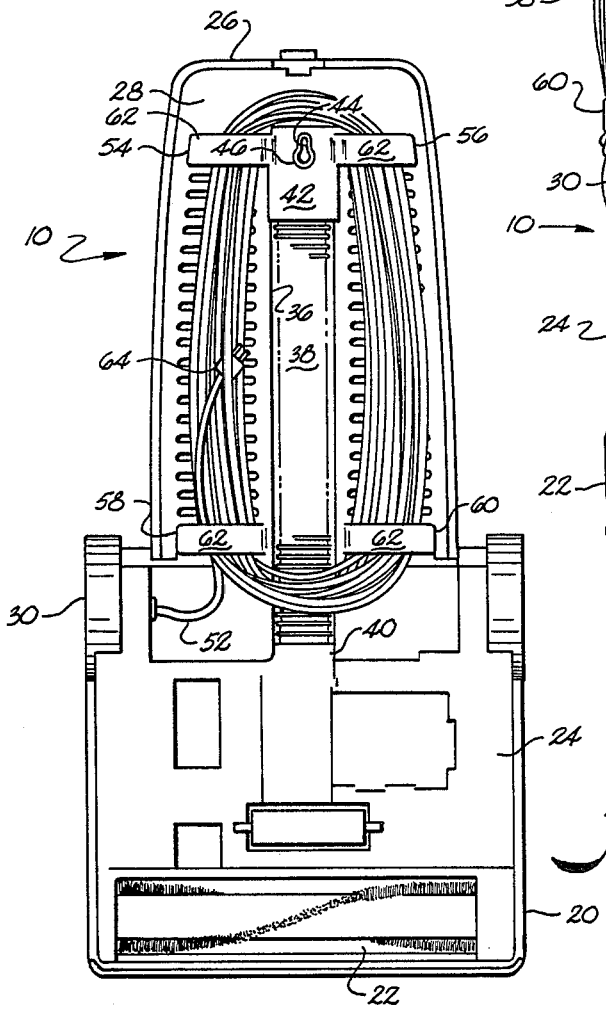

Referring to present FIGS. 2 and 3, side and rear elevational views, respectively, of the exemplary vacuum cleaner 10 of present FIG. 1 are illustrated. Vacuum cleaner 10 generally includes a head portion or main chassis 20 which has a vacuum nozzle 22 incorporated on a lower side 24 thereof. As illustrated, lower side 24 comprises a first substantially planar surface.

Vacuum cleaner 10 also includes a body portion or compartment 26 which receives therein a dust or dirt collection bag (not shown) having an input orifice, as well known by those of ordinary skill in the art. Body compartment 26 also has a lower side 28, which forms a second substantially planar surface, and which may be disposed in relatively co-planar alignment with lower surface 24 as illustrated. In general, head portion 20 and body portion 26 may be pivotably attached with respect to each other generally about an axis 30, as more particularly discussed in the above-mentioned U.S. Patents. Relative pivoting permits the achievement of co-planar alignment for surfaces 24 and 28 as illustrated, or upright operation as discussed in such patents.

Pivotable and extendable handle means 32 are further provided in accordance with the present exemplary embodiment, all for cooperation with the pivotable feature concerning axis 30 for converting vacuum cleaner 10 from a hand-held configuration (illustrated in the present Figures) to an upright configuration (illustrated in the above-mentioned incorporated U.S. patents). In general, the selection of position of handle means 32 does not for present purposes affect the functionality of the hanging arrangement of the present invention. In other words, the pivoted position of handle means 32 about the general pivot point 34 thereof does not affect hanging features associated with generally planar lower surface 12 of vacuum cleaner 10 since handle means 32 is situated on a side of vacuum cleaner 10 opposite lower side 12 thereof.

Furthermore, handle means 32 may alternatively be provided as either a permanently extended member or a permanently hand-held positioned member, all without substantially affecting the generally planar lower surface and related hanging features of the present invention.

Lower surface 12 includes a centrally located trough 36 extending along a longitudinal axis of body portion 26. Flexible tubing means 38 are generally received within trough 36, for operatively interconnecting an exhaust port 40 of chassis 20 with an input orifice of a dirt collection bag (not illustrated) located beneath tubing cover means 42 comprising a generally planar member situated across one end of trough 36. Though tubing 38 may occasionally protrude from trough 36 (as represented in present FIG. 2), it is adequately flexible to be pushed fully into trough 36, and out of the way for hanging, by the weight of vacuum cleaner 10 should the cleaner be supported directly flush on a support surface.

A vacuum channel (not illustrated) interconnects exhaust port 40 with vacuum nozzle 22. Also, suction means, as well known to those of ordinary skill in the art, may be provided in vacuum cleaner 10 for transporting dirt and dust from generally adjacert vacuum nozzle 22 to the dirt collection bag within body compartment 26, via such vacuum channel, exhaust port 40, flexible tubing means 38 and the bag input orifice located beneath tubing cover means 42. Examples of vacuum channels, suction means, and other such detailed aspects of vacuuming operations are more fully explained in the above-identified U.S. patents.

A support opening or hanging means 44 is defined in tubing cover means 42, preferably along the central axis of vacuum cleaner 10 for balanced hanging thereof (as illustrated in present FIG. 1). Hanging means 44 may assume various constructions, but preferably comprises a keyhole feature with reinforcement 46 about the periphery thereof. Cover means 42 may be injection molded (or alternatively formed) with the reinforced keyhole integrally formed therein. As better illustrated in FIG. 2, reinforced keyhole 44 is adapted to receive and engage the head 48 of an external support member such as a nail or screw mounted on a support surface such as a wall or beam 50.

As well understood by those of ordinary skill in the art, a power cord 52 is usually provided for supplying power to a suction means located within vacuum cleaner 10. Just as handle means 32 are preferably configured for avoiding interference with lower planar surface 12 and the related hanging features thereof, power cord wrapping or storage means are provided for accommodating power cord 52 also without interfering with hanging features of the present invention A power cord wrapping or storage means is provided in the presently illustrated exemplary embodiment by respective pairs of wing-like structures 54–60, which are provided generally on the lower surface of vacuum cleaner 10.

More particularly, respective pairs of elements 54–60 are preferably integrally formed with vacuum cleaner 10 (such as with injection molding or the like) so as to project slightly rearwardly and axially outwardly from the centrally formed trough 36 thereof. The winglike elements thus preferably form or define a third substantially planar surface 62 which is generally parallel to and slightly spaced from second substantially planar surface 28. The planar area thus formed between the slightly spaced planes of second planar surface 28 and third planar surface 62 forms an area within which power cord 52 may be coiled or wrapped about elements 54–60 without substantially altering the generally planar nature of lower surface 12 of vacuum cleaner 10. In general, the cord is kept within such planar area by wrapping successive coils of the cord outwardly one on top of each other, as better illustrated in present FIG. 3. As also represented by present Figure, the length of cord 52 is preferably selected so that plug head 64 thereof is received relatively near the middle (i.e. side) of the wrapped cord 52, rather than near wing-like elements 54–60, to further prevent interference with hanging operations.

Also, the surface of the generally planar member comprising tubing cover means 42 is slightly recessed from third planar surface 62 so that it also falls between second and third planar surfaces 28 and 62, respectively. Hence, the preferably slightly raised reinforcement structure 46 of hanging means 44 is not affected in its interaction with a planar support surface by the storage of power cord 52 on the present cord storage or wrapping means.

While various modifications and variations may be practiced, the foregoing exemplary embodiment represents one construction in accordance with the present invention which enables convenient, spacesaving hanging storage of a relatively lightweight, convertible vacuum cleaner providing either hand-held or upright service. The description set forth by the foregoing specification is intended as words of example and description only, and not words of limitation with respect to the present invention, which is more particularly defined below in the appended claims.

What is claimed is:

1. A vacuum cleaner having a head portion incorporating a vacuum nozzle; a body portion incorporating a collecting bag, said body portion being operatively and pivotably associated with said head portion, and upon selected pivoting thereof further defining together with said head portion a generally planar lower surface; cord storage means, received on said generally planar lower surface, for storing a coiled power cord for said vacuum cleaner in a storage plane generally parallel to and immediately adjacent to said generally planar lower surface; and vacuum cleaner hanging means, substantially facing said planar lower surface, and adapted for supporting said vacuum cleaner on an external support member mounted on a wall or similar planar support surface, with the vacuum cleaner planar lower surface substantially facing towards such planar support surface, and with the vacuum cleaner power cord stored on said cord storage means so as not to interfere with operation of said hanging means.

2. A vacuum cleaner as in claim 1, wherein said hanging means comprises a keyhole integrally formed on a lower side of said vacuum cleaner, and substantially centrally located relative a longitudinal cross-section thereof for balanced hanging of said vacuum cleaner.

3. A vacuum cleaner as in claim 2, wherein said keyhole includes reinforcement about the periphery thereof.

4. A vacuum cleaner as in claim 1, wherein:

said cord storage means comprises two respective pairs of wing-like members, which project rearwardly and then axially outwardly generally from along a central, longitudinal axis of said lower planar surface of said body portion; and said hanging means is located generally on one end of said central, longitudinal axis, and between two of said members forming one of said cord storage means respective pairs, for balanced storage of said vacuum cleaner.

5. A vacuum cleaner as in claim 4, further comprising extendable and foldable handle means associated with said body portion at an end thereof generally adjacent said central axis one end, said handle means being pivotable and foldable for situating same on a side of said body portion opposite that from said planar lower surface, so as to avoid interference with operation of said hanging means.

6. A vacuum cleaner adapted for hanging storage thereof during periods of non-use, said vacuum cleaner comprising:

a main chassis, including a lower side thereof defining a first substantially planar surface, at least one vacuum nozzle directed towards said chassis lower side, at least one exhaust port located generally towards the rear of said chassis, and at least one vacuum channel operatively interconnecting said vacuum nozzle with said exhaust port;

a body compartment adapted for supporting a dirt collection bag having an input orifice operatively interconnected with said chassis exhaust port, said body compartment having generally opposing ends, one of which is pivotably attached to said chassis rear, and the other of which is generally adjacent said bag input orifice, said body compartment further having a lower side thereof defining a second planar surface, with a trough formed substantially centrally in such body compartment lower side and running longitudinally therealong;

flexible tubing means, received substantially within said body compartment lower side trough, for operatively interconnecting said chassis exhaust port with said bag input orifice;

suction means for transporting dirt and dust from generally adjacent said vacuum nozzle to said dirt collection bag, via said vacuum channel, said exhaust port, said tubing means, and said bag input orifice;

a power cord for selectively interconnecting said suction means with input power from a source such as a wall socket;

cord wrapping means, including two respective pairs of elements with each such pair generally associated with respective opposing ends of said bag compartment and relatively adjacent said lower side trough thereof, for defining a third substantially planar surface which is parallel to and slightly spaced from said second planar surface, said cord wrapping means being further adapted for coiled receipt of said power cord therearound, generally in a plane within an area defined between said slightly spaced second and third planar surfaces; and tubing cover means, situated across one end of said body compartment lower side trough, for covering the interconnection between said tubing means and said bag input orifice, said cover means further being situated between a pair of said cord wrapping means elements, and defining centrally relative said vacuum cleaner a support opening adapted for receipt of a support member therein;

whereby, with said body compartment pivotably situated relative said main chassis such that their respective lower side planar surfaces are substantially in co-planar alignment, said vacuum cleaner may be stored during periods of non-use by hanging said support opening thereof on a support member, with said power cord wrapped about said cord wrapping means so as to generally not disturb the substantially planar nature of said planar surfaces so that said vacuum cleaner may be positioned substantially flush against a surface, such as a wall, from which said support member protrudes.

7. A vacuum cleaner as in claim 6, wherein said support opening comprises a reinforced keyhole structure adapted to receive and engage the head of a support member such as a nail or screw, said keyhole structure being centrally defined in said cover means, relative said body compartment lower side trough; and said cover means comprises essentially a planar member which bridges across said one end of said body compartment lower side trough.

8. A vacuum cleaner as in claim 6; further comprising an extendable handle pivotably mounted adjacent said other end of said body compartment, said handle being pivotable to a side of said body compartment opposite said lower side thereof, so as to avoid interference with operation of said cover means support opening and said cord wrapping means

9. A vacuum cleaner as in claim 6, wherein said vacuum cleaner is generally of relatively lightweight construction.

10. A vacuum cleaner as in claim 9, wherein said vacuum cleaner generally has a total weight of less than about ten pounds.

* * * * *